US007854080B2

(12) United States Patent
Conti

(10) Patent No.: US 7,854,080 B2
(45) Date of Patent: Dec. 21, 2010

(54) SYSTEM AND METHOD FOR PROVIDING SYNCHRONIZED MOVING OBJECTS IN AN ORNAMENTAL DISPLAY

(75) Inventor: Walter Conti, Woodside, CA (US)

(73) Assignee: Wynn Resorts Holdings, LLC, Las Vegas, NV (US)

( * ) Notice: Subject to any disclaimer, the term of this patent is extended or adjusted under 35 U.S.C. 154(b) by 315 days.

(21) Appl. No.: 12/194,922

(22) Filed: Aug. 20, 2008

(65) Prior Publication Data

US 2010/0043322 A1 Feb. 25, 2010

(51) Int. Cl.

| | |
|---|---|
| ***G09F 19/08*** | (2006.01) |
| ***G09F 19/12*** | (2006.01) |
| ***G09F 19/00*** | (2006.01) |
| ***G09F 7/22*** | (2006.01) |
| ***E03B 9/20*** | (2006.01) |
| ***B05B 17/08*** | (2006.01) |

(52) U.S. Cl. ..... 40/414; 40/412; 40/427; 40/429; 40/439; 40/617; 239/17; 239/18; 239/211; 239/16; 212/76; 212/83

(58) Field of Classification Search ..... 40/414, 40/412, 427, 429, 439, 617; 239/16, 17, 239/18, 211; 212/76, 83

See application file for complete search history.

(56) References Cited

U.S. PATENT DOCUMENTS

| | | | | |
|---|---|---|---|---|
| 4,710,819 | A | 12/1987 | Brown | |
| 7,127,998 | B2 | 10/2006 | MacDonald et al. | |
| 7,207,277 | B2 | 4/2007 | Rodnunsky | |
| 7,239,106 | B2 * | 7/2007 | Rodnunsky et al. | 318/649 |

* cited by examiner

*Primary Examiner*—Lesley Morris
*Assistant Examiner*—Syed A Islam
(74) *Attorney, Agent, or Firm*—Greenberg Traurig

(57) ABSTRACT

System and methods for providing synchronized ornamental displays in a presentation zone that is at least partially containing a fluid, which include a support structure, a decorative object supported by the support structure, a light disposed on the object, a plurality of cables coupled to the support structure at their respective first ends; a plurality of cable tensioning devices, wherein one cable tensioning device is engaged with the second end of a respective cable of the plurality of cables, and the plurality of cable tensioning devices are positioned spatially about the periphery of the presentation zone, wherein the spatial arrangement defines a range of desired movement for the object, and a control device operatively associated with the tensioning devices and light.

20 Claims, 9 Drawing Sheets

SYSTEM AND METHOD FOR PROVIDING SYNCHRONIZED MOVING OBJECTS IN AN ORNAMENTAL DISPLAY

BACKGROUND OF THE INVENTION

1. Field of the Invention

This invention relates to systems and methods for providing large scale ornamental displays.

2. Background of the Related Art

Ornamental displays or decorations are used to provide attractive or festive atmospheres in homes, churches, businesses, malls, parks, public areas, and the like. Decorations and displays are also used by businesses to promote or advertise their products and services. Other examples of uses for displays include conferences, festivals, celebrations, theme parks, and the like.

The simplest forms of displays include two dimensional images such as pictures, charts and printed advertisements. Other displays may involve a two dimensional video image that includes shows movement. Three dimensional displays, such as decorations, symbols, and large mockups of commercial products, typically do not provide for any movement within the display itself. Occasionally you may notice a billboard or store window with animated objects, but these displays are generally limited to certain motions. Furthermore, these motions are typically repetitive, and even if randomly generated, do not consist of a sequence of varying motions in timed coordination with other audio or visual aspects to create an artistic presentation.

It would be desirable to have a display that would accommodate more than just a limited amount of objects and motions to provide an aesthetically-pleasing experience. What is needed is a system and method that provides fluid movement of intriguingly-shaped objects in coordination with accompanying audio and visual features to create a synergistic display of artistic merit that attracts greater attention and provides more entertainment for onlookers or patrons than any prior displays.

SUMMARY OF THE INVENTION

The present invention is directed to systems and methods which, among other things, solves the aforementioned need in the art.

In some embodiments, the present invention is directed to a system for providing a synchronized ornamental display in a presentation zone at least partially containing a fluid. In some embodiments, the system includes a support structure, wherein the support structure may be at least partially submerged in the fluid during operation of the ornamental display; a decorative object supported by the support structure, wherein the object is substantially viewable during operation of the ornamental display; a light disposed on the object, wherein the light is capable of being illuminated by a remote signal; a plurality of cables coupled to the support structure at their respective first ends; a plurality of cable tensioning devices, wherein one cable tensioning device is engaged with the second end of a respective cable of the plurality of cables, and the plurality of cable tensioning devices are positioned spatially about the periphery of the presentation zone, wherein the spatial arrangement defines a range of desired movement for the object; and a control device operatively associated with the tensioning devices and light, wherein the control device is configured to control movement of the supporting structure by changing, affecting or otherwise altering the amount of tension applied to one or more of the plurality of cables by the corresponding cable tensioning devices and operate the light by wired or wireless connection, or an otherwise remote signal.

In some embodiments, the tension in the cables may be increased, decreased or held substantially at a constant value or within a specific range of values. In other embodiments, the cable tensioning devices are configured to hold, pull or take in and/or release cable or portions thereof, and the tension in the cables may held substantially constant or within a specific range of values while such actions are carried out.

In some embodiments, the support structure comprises a cylindrical member and an elongated member. The elongated member may extend substantially perpendicular with respect to one of the parallel planes of the cylindrical member. The elongated member may also have a first end connected to the cylindrical member and a second end associated or connected with the object.

In some embodiments, the support structure comprises a base, an elongated member or sleeve having a first end connected with the base and a substantially longitudinal bore extending therein, a motor mounted in the base and a shaft extending through the longitudinal bore in the elongated member. The shaft includes a first end connected with the decorative object and an opposing second end engaged and operatively associated with the motor to be moved linearly through the bore. In some embodiment, the motor is responsive to the control device and configured to cause the shaft to move in reciprocating linear motion through the longitudinal bore, resulting in the corresponding motion of the decorative object engaged thereto.

In some embodiments, the first end of each cable of the plurality of cables is connected to the cylindrical member.

In some embodiments, the object is substantially spherical, but it may also be of any size, shape or form desirable.

In some embodiments, the object includes a hollowed out portion for mounting a light therein. Additionally, there may be one or more lights positioned within the presentation zone. These lights may be controlled by the control device.

In some embodiments, the cable tensioning devices include a support structure, a drum mounted for rotational motion on the support structure, and a motor for driving the rotational motion of the drum.

In some embodiments, the control device further includes at least one transmitter positioned adjacent the presentation zone and a control program for operating the synchronized ornamental display by transmitting signals to the cable tensioning devices and light to direct operation thereof.

The present invention is also directed to a system for providing a synchronized ornamental display in a presentation zone at least partially containing a fluid, which includes a plurality of movable bodies. Each movable body may include a support structure, wherein the support structure may be at least partially submerged in the fluid during operation of the ornamental display; a decorative object supported by the support structure, wherein the decorative object is substantially viewable during operation of the ornamental display; a light disposed on the object, wherein the light is capable of being illuminated by a remote signal; and a plurality of cables coupled to the support structure at their respective first ends.

The system also includes a plurality of sets of cable tensioning devices. Each set of cable tensioning devices include a plurality of cable tensioning devices, which are in turn operatively associated with one of the plurality of movable bodies. Each cable tensioning device in each set are further engaged with a respective second end of one cable of the plurality of cables coupled to the support structure of one movable body. The cable tensioning devices of each set are positioned spatially about the periphery of the presentation zone and the spatial arrangement defines a range of desired movement for the operatively associated movable body. In some embodiments, the plurality of cables associated with each movable object are positioned within the fluid to avoid contact with one another.

The system further includes a control device operatively associated with the tensioning devices and one or more lights. The control device is configured to control movement of the one or more movable bodies by changing the amount of tension applied to one or more of the plurality of cables engaged by the respective sets of cable tensioning devices.

In some embodiments, the tension in the cables may be increased, decreased or held substantially at a constant value or within a specific range of values. In other embodiments, the cable tensioning devices are configured to hold, pull or take in and/or release cable or portions thereof and the tension in the cables may held substantially constant or within a specific range of values while such actions are carried out.

In some embodiments, the support structure comprises a cylindrical member and an elongated member. The elongated member may extend substantially perpendicular with respect to one of the parallel planes of the cylindrical member. The elongated member may also have a first end connected to the cylindrical member and a second end connected with the object.

In some embodiments, the first end of each cable of the plurality of cables is connected to the cylindrical member.

In some embodiments, the decorative object of at least one movable body is substantially spherical.

In some embodiments, the decorative object of at least one movable body includes a hollowed out portion for mounting a light therein. Additionally, there may be one or more lights positioned within the presentation zone. These lights may be controlled by the control device.

In some embodiments, the cable tensioning devices include a support structure, a drum mounted for rotational motion on the support structure, and a motor for driving the rotational motion of the drum.

In some embodiments, the control device further includes at least one transmitter positioned adjacent the presentation zone and a control program for operating the synchronized ornamental display by transmitting signals to the cable tensioning devices and light to direct operation thereof.

The present invention is also directed to a method for providing a synchronized ornamental display in a presentation zone at least partially containing a fluid. In some embodiments, the method may include the steps of actuating a light disposed on a movable body, wherein the movable body comprises a decorative object supported by a support structure, and the support structure may be at least partially submerged in the fluid during operation of the ornamental display; and causing movement of the movable body through the fluid by changing the balance of tension in a plurality of cables relative to one another, wherein each cable is coupled at one respective end with the support structure and engaged at a second respective end with a cable tensioning device. In some embodiments, the movement of the movable body and actuation of the light are controlled by a remote control device which may be provide operative signals according to a preprogrammed event, at certain times or by human control, among other things.

The movement of the movable body through the fluid by changing the balance of tension in a plurality of cables may be caused by holding, pulling and releasing portions of the cables.

These and other aspects of the system and method of the subject invention will become more readily apparent to those having ordinary skill in the art from the following detailed description of the invention taken in conjunction with the drawings.

BRIEF DESCRIPTION OF THE FIGURES

So that those having ordinary skill in the art to which the present invention pertains will more readily understand how to make and use the method and system of the present disclosure, embodiments thereof will be described in detail herein below with reference to the drawings, wherein.

DETAILED DESCRIPTION OF THE INVENTION

Figure 1:
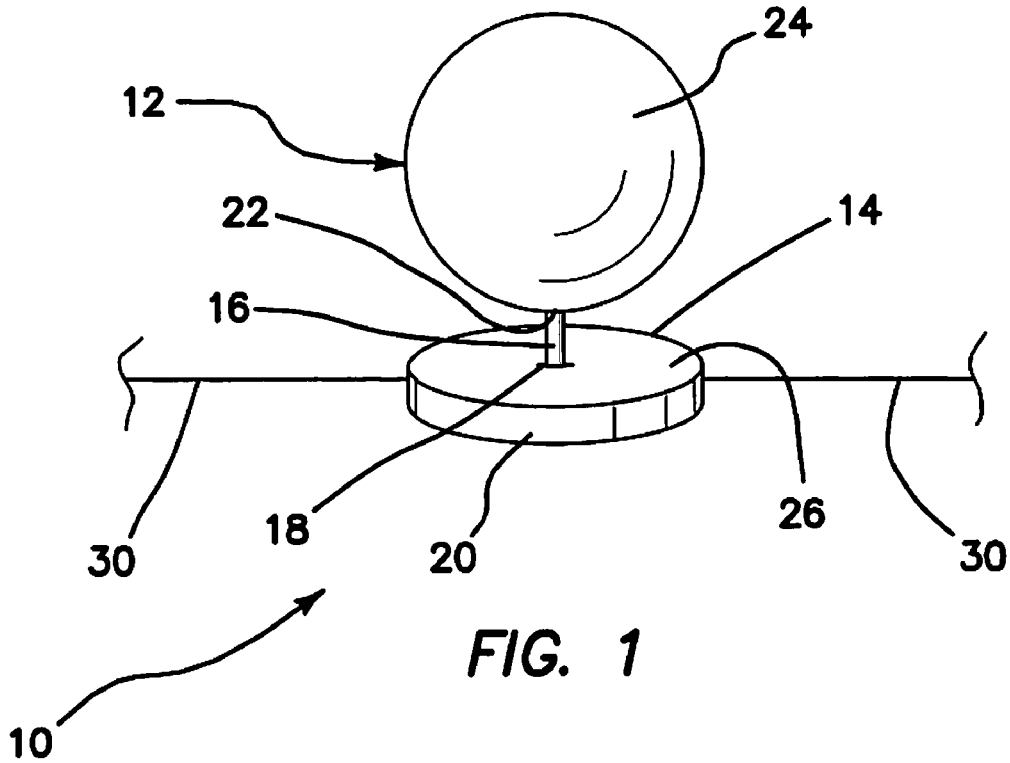
FIG. 1 is a perspective view of an ornamental object constructed for use with some embodiments of the present invention.

The advantages of systems and methods of the present invention will become more readily apparent to those having ordinary skill in the art from the following detailed description of certain preferred and exemplary embodiments taken in conjunction with the drawings, which are not intended to limit the scope of the present invention.

Some embodiments of the invention are directed to systems and methods for providing synchronized movement of one or more objects throughout one or more preset zones as part of an ornamental presentation. It should be noted that a given reference numeral indicates the same or similar structure when it appears in different figures, and like reference numerals in different figures identify similar structural elements and/or features of the invention.

In some embodiments, a system 10 of the present invention includes an object 12 (hereinafter generally referred to as "orb" 12) consisting of a support structure 14 formed by a pole 16 having a first end 18 attached to a generally disc-shaped base 20 and a second end 22 either attached or associated with a substantially spherical body 24 as shown in FIG. 1. It should be understood that body 24 may be of any size, shape, of form desirable, such as for example, a square, a symbol or a representative sculpture of a human ballet dancer. In this embodiment, pole 16 extends substantially perpendicular relative to an upper surface 26 of base 16. Pole 16 may be attached to base 16 and body 20 by any conventional permanent or non-permanent fastening method, technique or device.

In some embodiments, orb 12 includes one or more lights, such as LED lights, bulbs or the like, within a hollowed portion defined in body 24. Lights may also be disposed on other portions of orb 12, such as on the exterior surface of body 24, on base 20 or pole 16.

In some embodiments, body 24 may be constructed of a material having particularly desirable physical properties or material characteristics. For example, body 24 may be constructed of a material that is sufficiently opaque to conceal any interior electronics or structure from visual inspection, such as mechanical or electrical parts that facilitate the placement and operation of lights therein and coupling of body 24 to pole 16, while being sufficiently transparent to allow the illumination of lights positioned inside body 24 to be viewable from a position outside of its exterior.

In some embodiments, the present invention is configured to cause the illumination and movement of one or more objects, such as orb 12, within a substantially planar (i.e., two-dimensional) range within a presentation zone according to a preset movement control program or by direct manipulation from a remote location.

Those skilled in the art will readily appreciate that a control system for the present invention may include various computer or computer-related software and hardware for facilitating the collective operation of the present invention, such as programs, operating systems, memory, data storage devices, data input/output devices, data processors, data communication devices, electromechanical device and data transceivers, wireless or otherwise, and data receiving controllers for electromechanical devices. Those skilled in the art will further appreciate that, so long as its users are provided with systems and methods to control the collective illumination and movement of one or more objects in an ornamental presentation, the precise software and hardware used is not vital to its full implementation.

Figure 2:
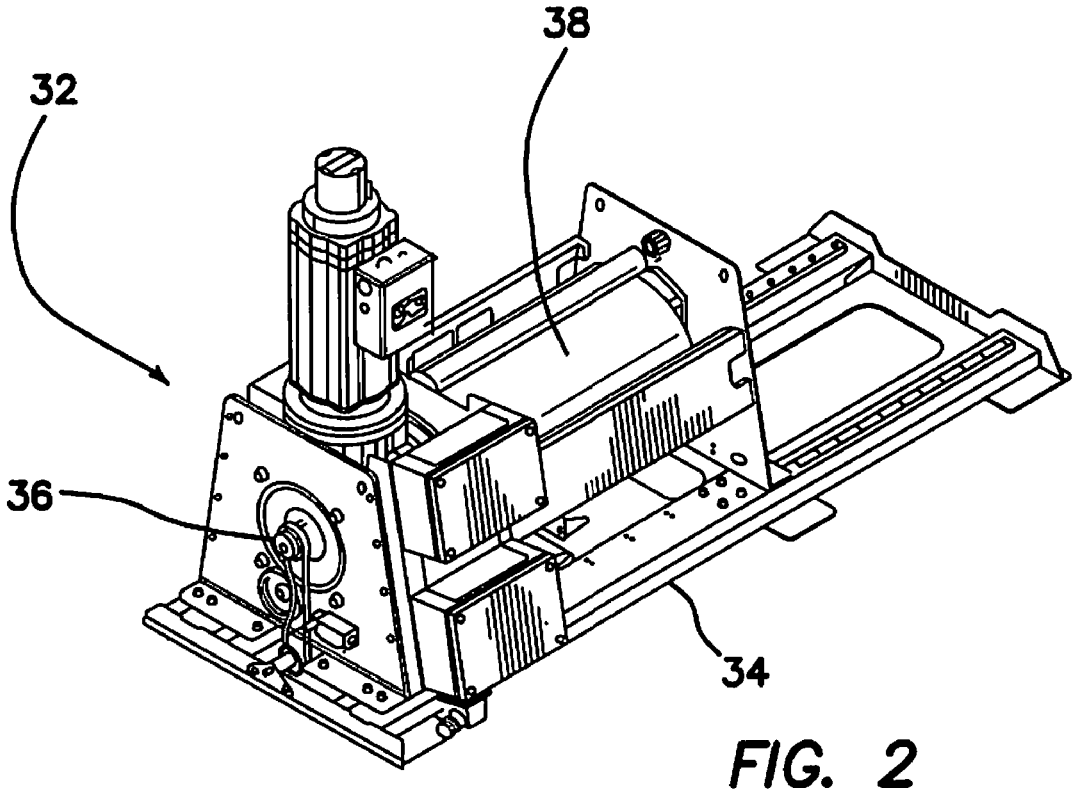
FIG. 2 is a perspective view of a device used in accordance with some embodiments of the present invention for moving the ornamental object.

In some embodiments, the movement of one or more orbs 12 within certain range of the presentation zone is controlled mechanically by a set of cables 30, wherein each cable 30 is coupled to base 20 at a first end and engaged at their respective second ends with a cable pulling device 32 (shown in FIG. 2). The term cable as used herein is also meant to refer to a rope, line, wire or other possibly flexible element that can be adapted for use as described herein.

In some embodiments, cable pulling device 32 includes a support structure 34, a motor 36 and a drum 38 mounted on support structure 34 to facilitate rotational motion thereof. Motor 36 is operatively associated with drum 38 to cause drum 38 to rotate in a clockwise or counterclockwise direction. In other embodiments, support structure 34 may be further configured to support additional motor and drum arrangements thereon. A cable 30 is attached to drum 38 and may be either wound onto drum 38 or unwound from drum 38, by alternating the rotational motion of drum 38. It should be readily apparent that causing cable 30 to be wound onto drum 38 will pull cable 38 or cause tension therein, whereas causing cable 30 to be unwound from drum 38 will allow cable 38 to slack and release tension therein.

In the embodiment shown in FIGS. 3-5, a plurality of cable pulling devices 32 (also referred to hereinafter as "winch" 32) are positioned at locations adjacent the periphery of a presentation zone 40. Each winch 32 is associated with a cable 30 also attached to an orb 12 at its other end. The relative position of each winch 32 forms a desired range of movement 28 for orb 12 within presentation zone 40. For convenience sake, the range of movement 28 for orb 12 is described herein using the rectangular or Cartesian coordinate system.

Figure 3:
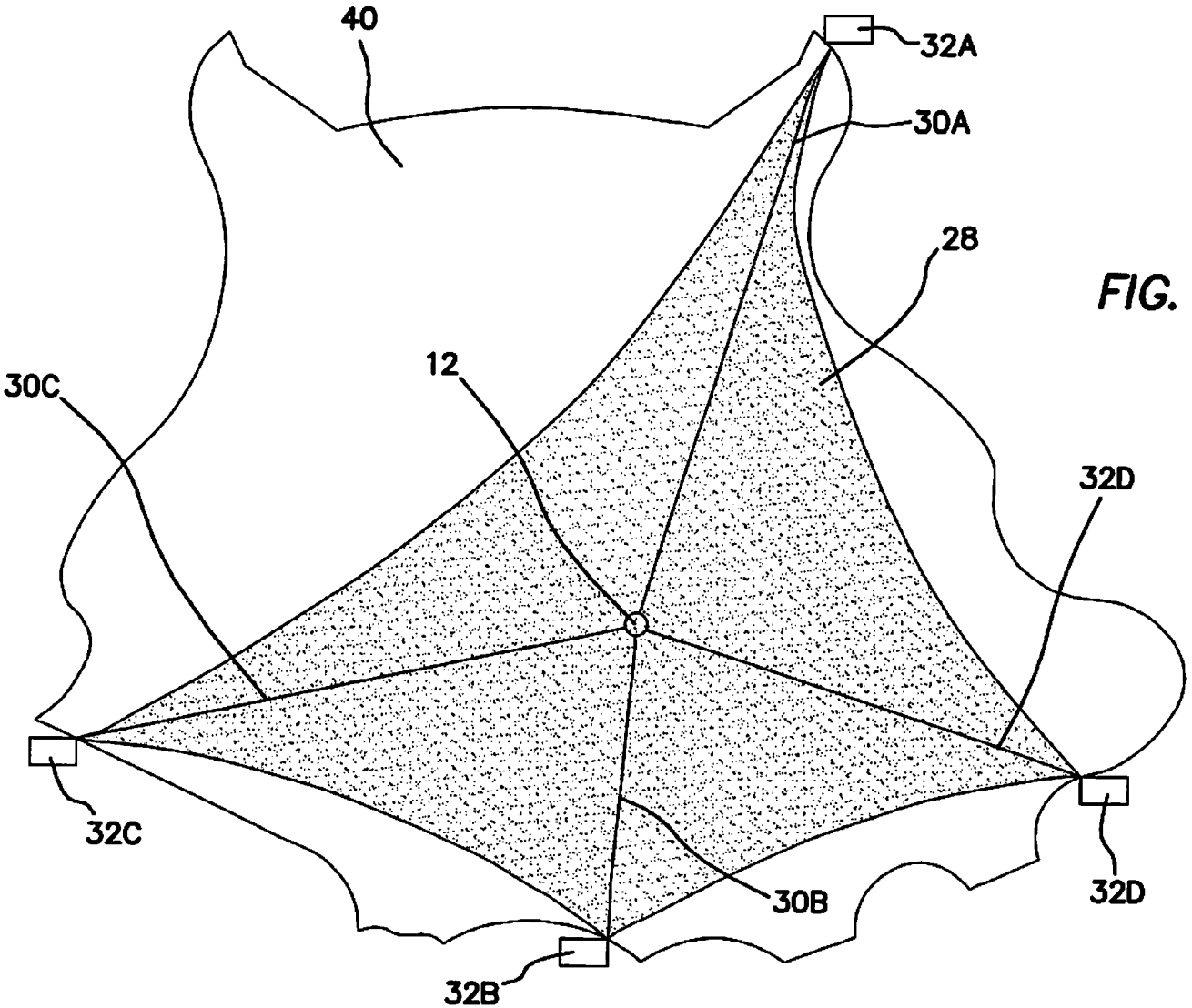
FIG. 3 is a schematic top view of an exemplary range of movement for an ornamental object within a presentation zone in accordance with some embodiments of the present invention.

Thus, in FIG. 3, winches 32A and 32B, with corresponding cables 30A and 30B connected respectively to orb 12, are positioned to effectuate movement of orb 12 in a path generally along the x-axis. In particular, winch 32A is able to directly effect movement of orb 12 in the positive x-direction, while winch 32B is able to directly effect movement of orb 12 in the negative x-direction.

Similarly, winches 32C and 32D, with corresponding cables 30C and cable 30D connected respectively to orb 12, are positioned to effectuate movement of orb 12 in a path generally along the y-axis. Winch 32C is able to directly effect movement of orb 12 in the negative y-direction, while winch 32D is able to directly effect movement of orb 12 in the positive y-direction.

It should be understood that the use of the term path as related to X-axis or Y-axis movement should not be limited to a linear path but may include a curved path. Although the terms X-axis movement and Y-axis movement refer to moving an object primarily in the respective X-axis and Y-axis directions, the paths through range 28 may be curved depending on where orb 12 is located and under what type of movement it is undergoing.

In order to effectuate movement of orb 12 throughout range 28, winches 32A-D operate by collectively and/or independently causing the winding or unwinding of their respective cables 30A-D. For example, by winding or drawing in cable 30A to winch 32A while simultaneously unwinding cables 30B-D from winches 32B-D, orb 12 will move in the positive x direction, towards winch 32A.

It should be readily apparent that the alternate winding and unwinding of cables 30A-D via winches 32A-D at varying rotational speeds will allow orb 12 to move in any desired direction within range 28 and at varying velocities. Winches 32A-D may also be configured and programmed so that orb 12 will move throughout range 28 as desired while maintaining the amount of tensile forces applied on each cable 30A-D at an equilibrium or constant amount without substantial deviation. However, winches 32A-D may cause slack in one or more cables 30A-D to create a variety of aesthetic impressions based on the responsive motions of orb 12, among other things, and allow for movement of orb 12 in a three dimensions (i.e., along the z-axis, or upward and downward).

In some embodiments, movement of spherical body 24 in the z-axis is provided by an motorized lifting system (not shown) installed in support structure 14, which is in communication with a transceiver for receiving control signals from a remote transmitter. The remote transmitter may receive signals from a control system configured for directing movement of orb 12. In some embodiments, the motorized lifting system for moving spherical body 24 both upward and downward (i.e., in both the negative and positive directions along the z-axis), includes a motor (not shown) mounted within base 20 for operating a shaft (not shown) which extends through a bore (not shown) in pole 16 from base 20 to spherical body 24. In some embodiments, this shaft is attached to spherical body 24 adjacent second end 22 of pole 16, while pole 16 is not fixedly attached to spherical body 24 at second end 22. The motor and shaft are configured to cause the shaft to move in both the negative and positive directions along the z-axis by any conventional means such as for example, by using cams or another means for converting circular motion to linear motion. This, upon actuation by a control signal, the motor causes the shaft to move upward and/or downward through the bore in pole 16, thus causing a corresponding response in spherical body 24. This configuration may be used to make spherical body 24 appear to be bouncing, among other things.

Figure 4:
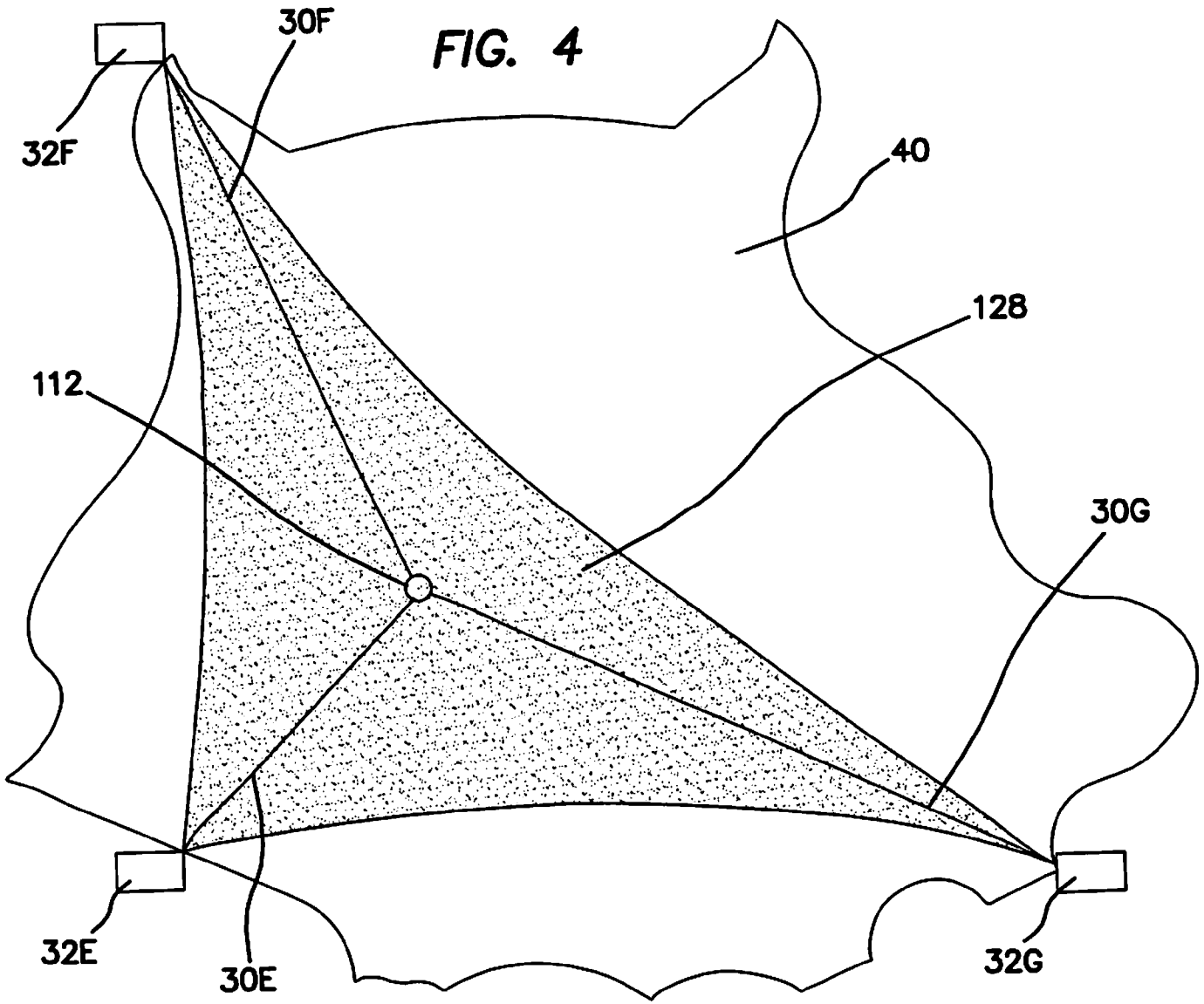
FIG. 4 is a schematic top view of another exemplary range of movement for an ornamental object within a presentation zone in accordance with some embodiments of the present invention.
Figure 5:
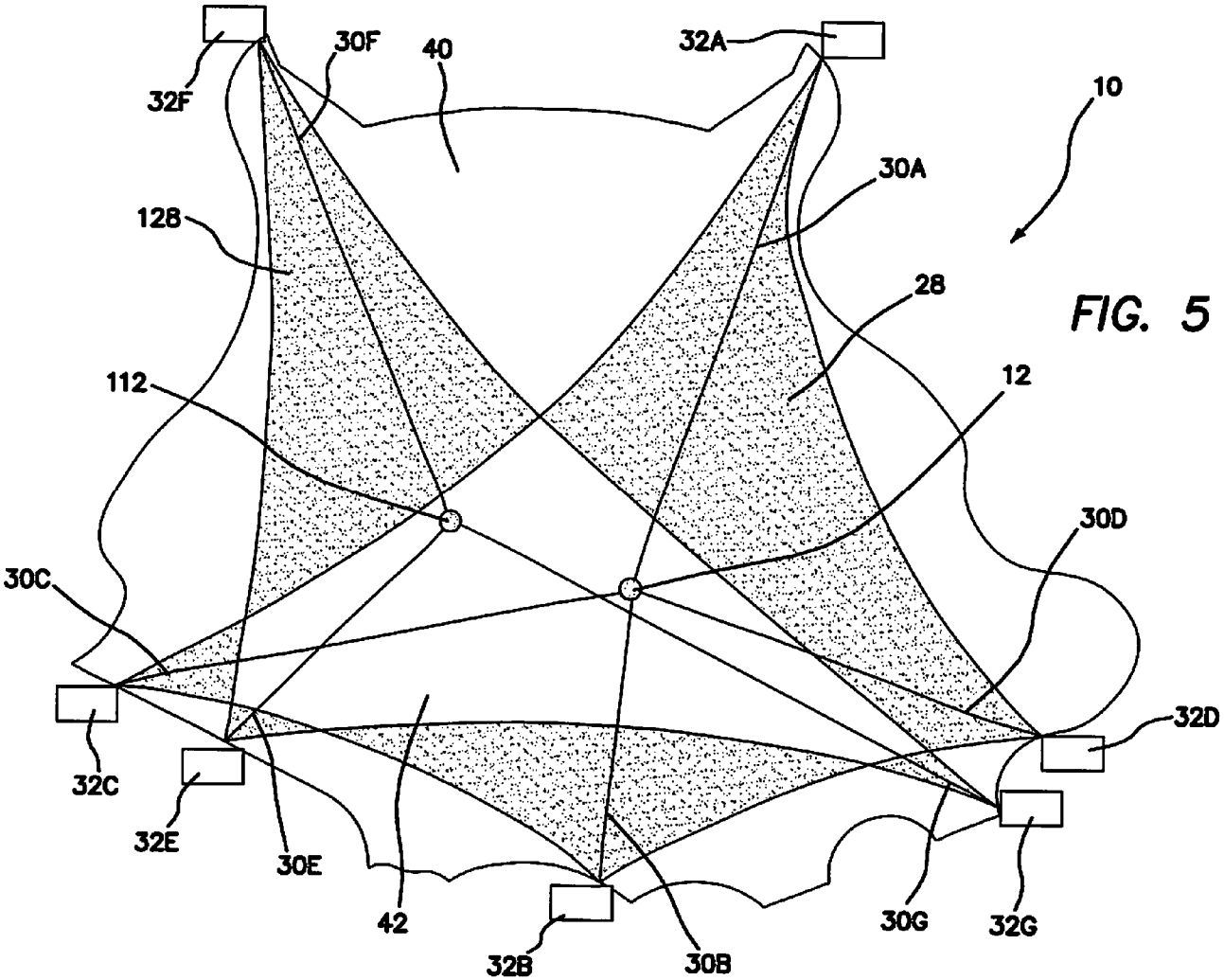
FIG. 5 is a schematic top view of the exemplary ranges of movement shown in FIG. 3 and FIG. 4 shown together to illustrate the overlapping range of movement, among other things.
Figure 6:
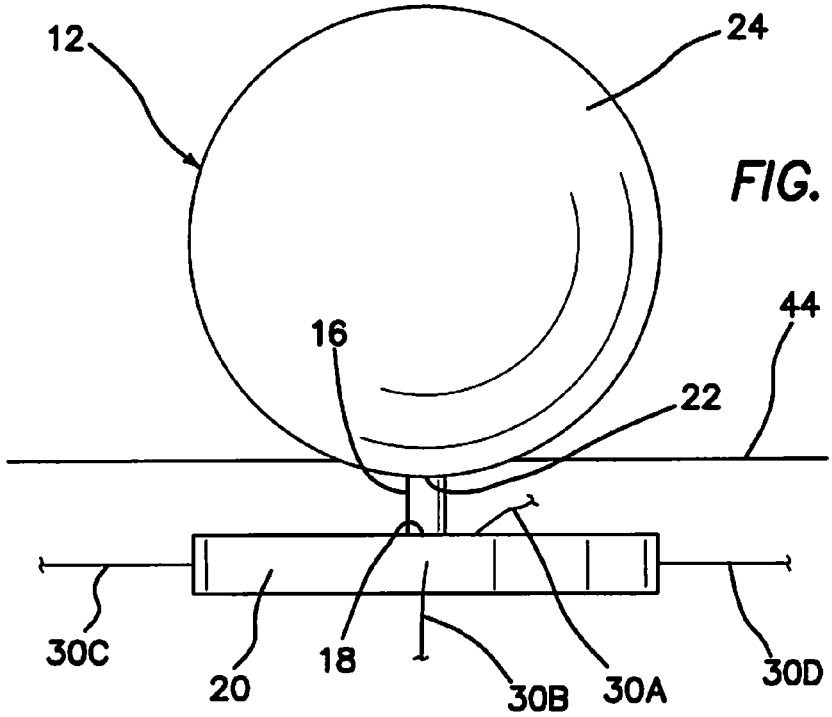
FIG. 6 is a schematic front view of another embodiment of an ornamental object constructed in accordance with the present invention.
Figure 7:
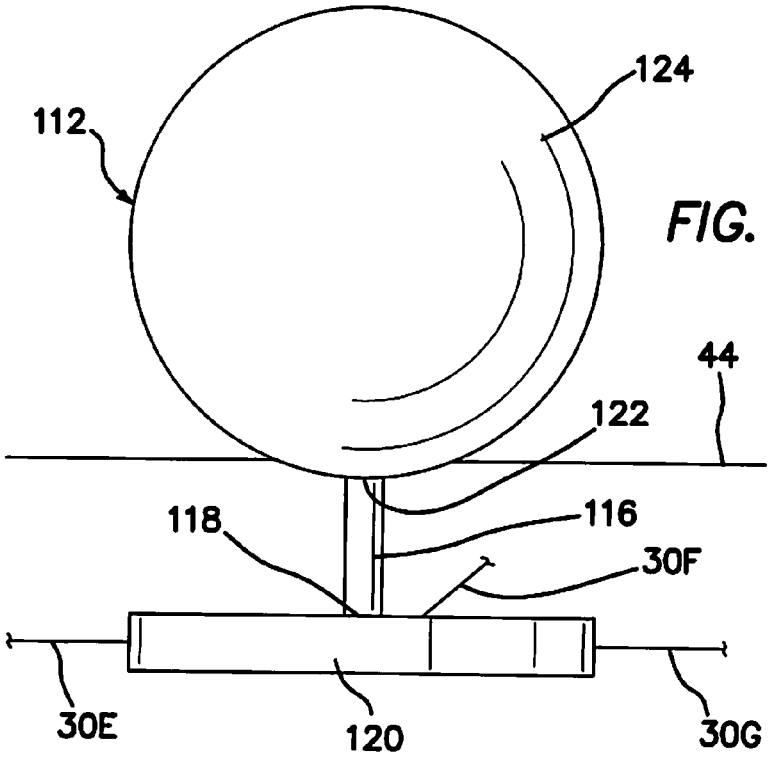
FIG. 7 is schematic front view of yet another embodiment of an ornamental object constructed in accordance with the present invention.

As shown in FIGS. 4 and 5, a second orb 112 operatively associated with cables 30E-G and corresponding winches 32E-G is arranged along the periphery of presentation zone 40. Orb 112 is configured for movement within range 128 in the same manner described above with respect to orb 12 and range 28. In this embodiment, cables 30E-G are positioned to sufficiently avoid interference with cables 30A-D, at least in range 42 where the cables for orbs 12 and 112 may overlap. For example, cable 30E-G and cables 30A-D may be positioned on differing planes or heights of sufficient distance to avoid interference that may impede the movement of orbs 12 and 112 throughout respective ranges 28 and 128. In addition, the configuration and/or sizing of support structure 14 may be altered to compensate for the height difference in the cables. For example, as shown in FIGS. 6 and 7, pole 16 of orb 12 is of a relatively shorter length than pole 116 of orb 112.

In some embodiments of the invention, cables 30A-G extend through air within presentation zone 40. In other embodiments, cables 30A-G may extend through water, air, fog or combinations thereof, or may be otherwise concealed by a fluid within presentation zone 40 so that orbs 12 and 112 appear to be moving without the assistance of any mechanical devices.

It should be understood that a fluid as used in accordance with the present invention may include liquids, gases, or combinations thereof, as well as mixtures of solid particles of any size, wherein the solid particles may or may not themselves be suspended in a liquid or gas. Non-limiting examples of fluids which may be used with the present invention include fog, water, and beads, either piled together or suspended in a gas or liquid, among other things.

In an embodiment in which presentation zone 40 includes water, cables 30A-G may be hidden either by virtue of being under the water itself, or by being camouflaged with paint or other coloring that makes cables 30A-G difficult to discern within the water in presentation zone 40. Furthermore, the water and its natural buoyancy forces and reflective properties may impart interesting capabilities and provide unique ornamental features in the motion and display of the orbs 12 and 112 in a system according to the present invention. For example, spheres 24 and 124 may be the only portion of orbs 12 and 112, respectively, visible above a water line 44, as shown in FIGS. 6 and 7. It is within the scope of the present invention that various other lighting, visual and/or audio effects may be added in presentation zone 40 to further enhance the overall experience and value of the display.

Figure 8:
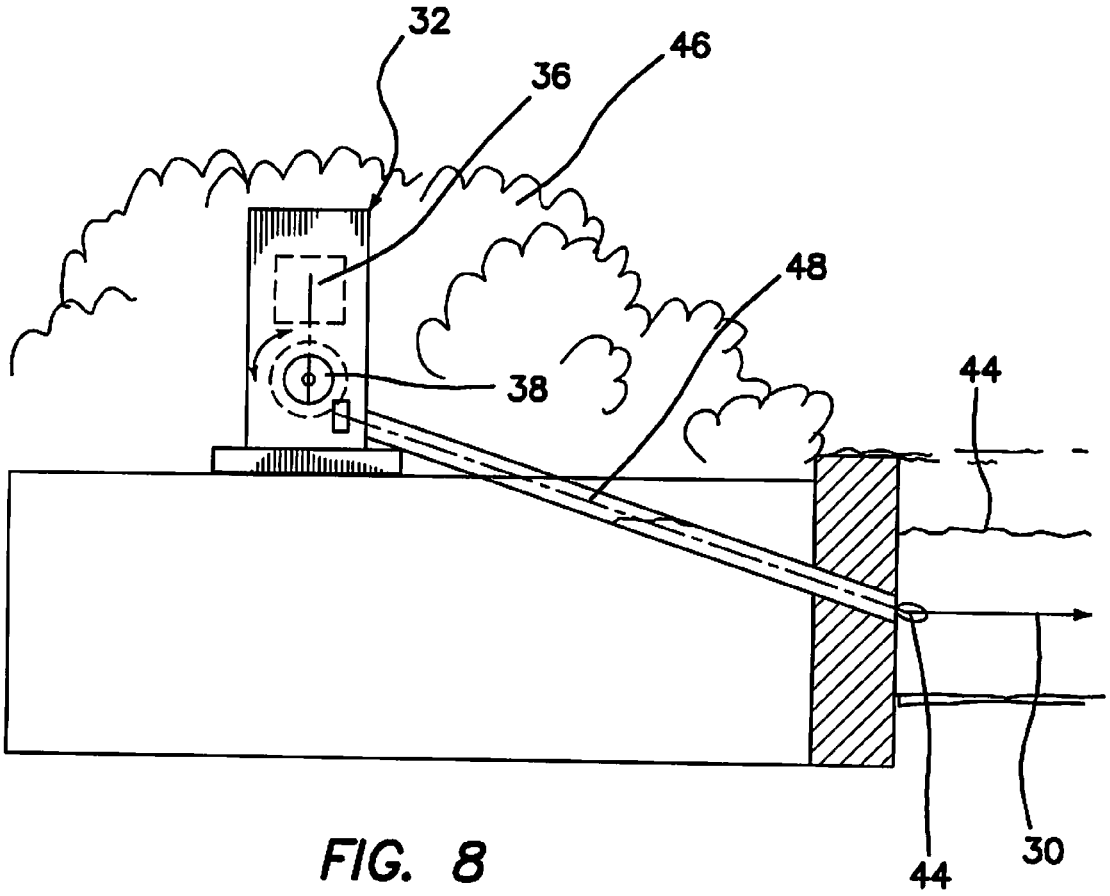
FIG. 8 is a schematic side view of components used in some embodiments of the present invention, illustrating the manner in which such components may be placed for improved aesthetics, among other things.
Figure 9:
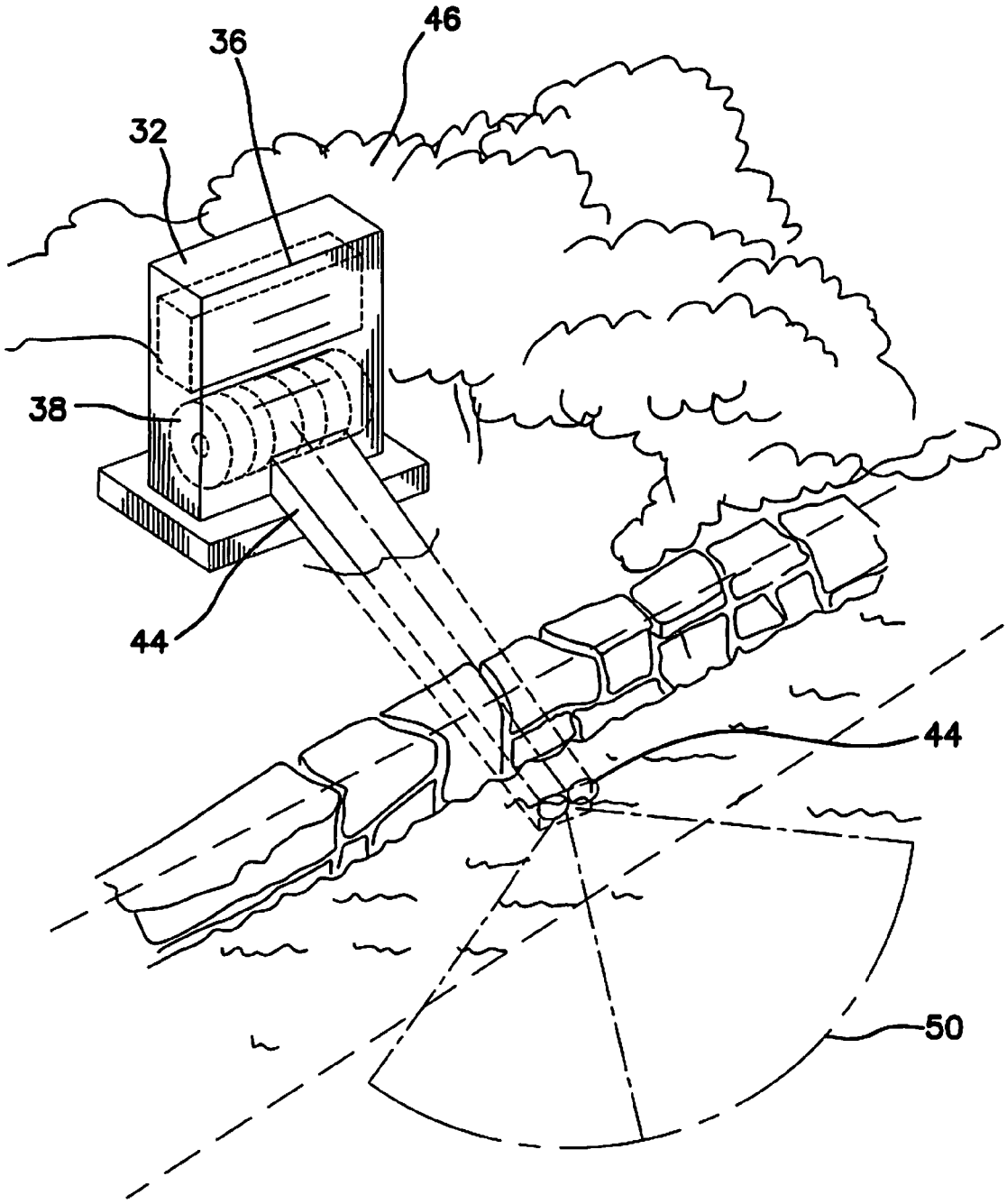
FIG. 9 is a schematic perspective view of the components shown in FIG. 8.
Figure 10:
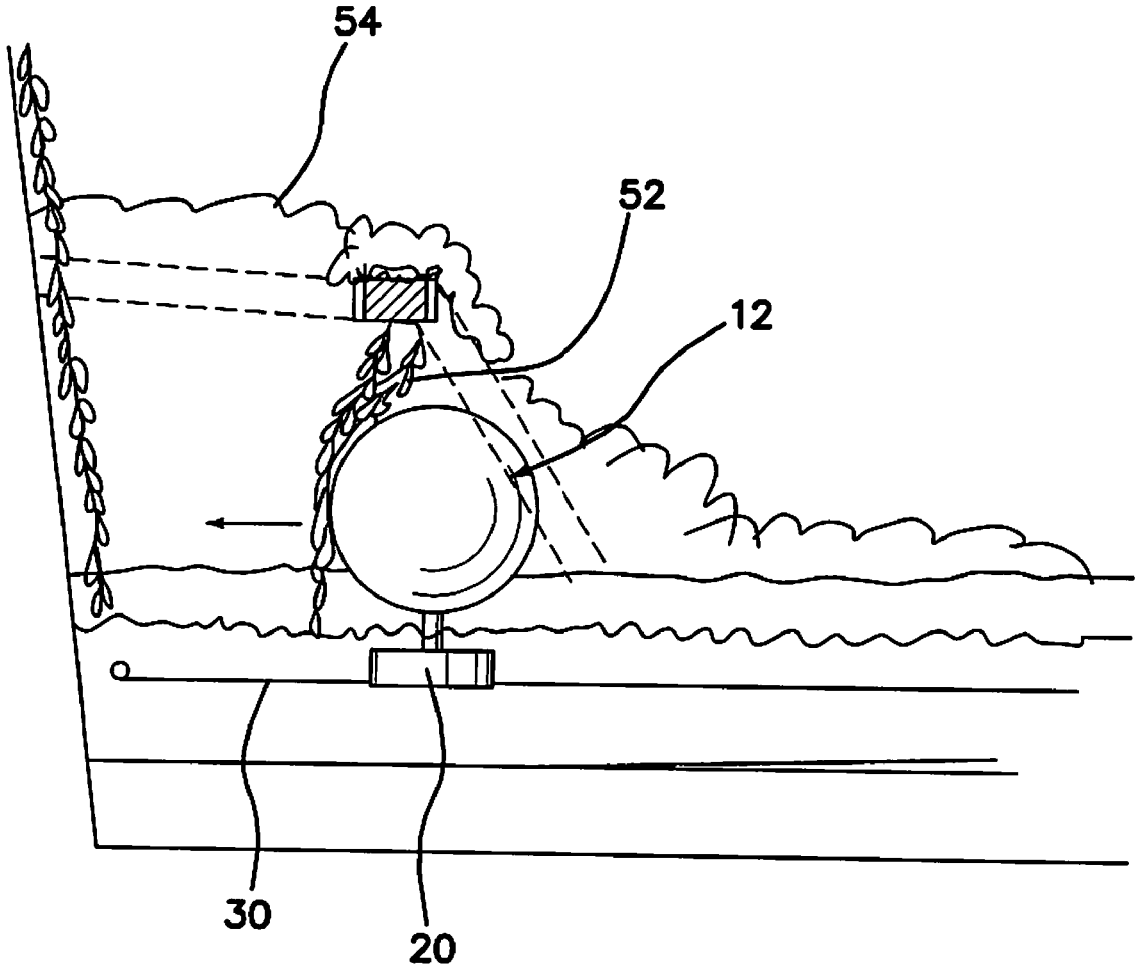
FIGS. 10 and 11 provide schematic side views of a movable object used in some embodiments of the present invention, illustrating the manner in which the movable object may be hidden from sight, among other things.
Figure 11:
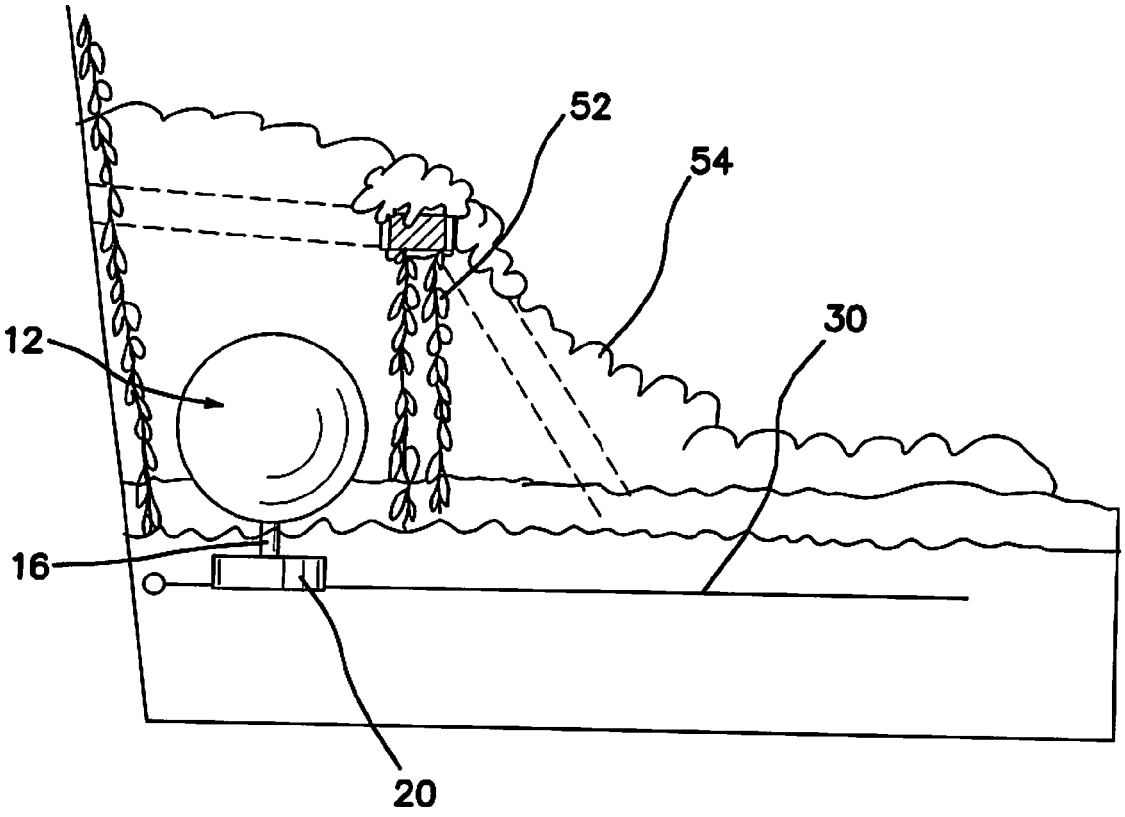

Winches 32 may be camouflaged about the periphery of presentation zone 40 by using natural and/or strategically placed landscaping, such as landscape screening 46 and a cable conduit 48 as shown in FIGS. 8 and 9. Cable conduit 48 may extend underground or through other foundation material to run cable 30 from winch 32 into presentation zone 40 and allow for the lateral movement of cable 30 within its respective range as shown by exemplary arc 50 in FIG. 9. Orbs 12 and 112 may also be hidden during display downtime by moving each orb into a camouflaged position set within their respective ranges 28 and 128, such as behind concealment blinds 52 and landscaping 54 as shown in FIGS. 10 and 11. Other components of a system in accordance with the present invention may be positioned adjacent presentation zone 40 and camouflaged in a similar manner, such as wireless transmitters for controlling movement of orbs 12 and 112.

In the exemplary descriptions provided herein there are numerous specific details set forth in order to provide a more thorough understanding of some of the embodiments of the invention. It will be apparent, however, to an artisan of ordinary skill that the present invention may be practiced without incorporating all aspects of the specific details described herein. Although the description herein is provided in sufficient detail for one skilled in the art to make, use and practice the invention, it should be understood that some specific features, quantities, sizes and/or measurements may have not been described in detail because, among other things, the invention should not be limited as such, and so as not to obscure the invention.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof it is to be understood that all matters hereinabove set forth or shown in the accompanying drawing are to be interpreted as illustrative and not in a limiting sense.

Those skilled in the art will recognize that the concepts, structures, systems, and methods of this disclosure may be implemented in many manners and as such this disclosure is not to be limited by the exemplary embodiments and examples set forth herein. In other words, functional elements may be performed by a single or multiple components, by various combinations of hardware and software, or both. In this regard, any number of the features of the different embodiments described herein may be combined into single or multiple embodiments, and alternate embodiments having fewer than or more than all of the features herein described are possible. Functionality may also be, in whole or in part, distributed among multiple components, in manners now known or to become known. Thus, myriad software and hardware combinations are possible in achieving the functions, features, interfaces and preferences described herein.

Moreover, the scope of the present disclosure covers conventionally known manners for carrying out the described features and functions and interfaces, and those variations and modifications that may be made to the hardware or software components described herein as would be understood by those skilled in the art now and hereafter. Numerous other changes may be made which will readily suggest themselves to those skilled in the art and which are encompassed in the spirit of this disclosure. It is to be understood that modifications and variations may be utilized without departure from the spirit and scope of the system and method of the present invention, as those skilled in the art will readily understand. Such modifications and variations are considered to be within the purview and scope of the appended claims and their equivalents.

What is claimed is:

1. A system for providing a synchronized ornamental display in a presentation zone at least partially containing a fluid, comprising: a support structure, wherein the support structure is at least partially submerged in the fluid during operation of the ornamental display; a decorative object supported by the support structure, wherein the object is substantially viewable during operation of the ornamental display; a light disposed on the object, wherein the light is capable of being illuminated by a remote signal; a plurality of cables coupled to the support structure at their respective first ends; a plurality of cable tensioning devices, wherein one cable tensioning device is engaged with the second end of a respective cable of the plurality of cables, and the plurality of cable tensioning devices are positioned spatially about the periphery of the presentation zone, wherein the spatial arrangement defines a range of desired movement for the object; and a control device operatively associated with the tensioning devices and light, wherein the control device is configured to control movement of the supporting structure by changing the amount of tension applied to one or more of the plurality of cables by the corresponding cable tensioning devices and operate the light by remote signal.

2. A system as recited in claim 1, wherein the support structure comprises a cylindrical member and an elongated member, the elongated member extending substantially perpendicular with respect to one of the parallel planes of the cylindrical member and having a first end connected thereto and a second end associated with the object.

3. A system as recited in claim 2, wherein the first end of each cable of the plurality of cables is connected to the cylindrical member.

4. A system as recited in claim 1, wherein the wherein the support structure comprises:

a base;

an elongated member, having a first end connected with the base and a substantially longitudinal bore extending therein;

a motor mounted in the base; and a shaft extending through the longitudinal bore in the elongated member, the shaft having a first end connected with the decorative object and an opposing second end engaged and operatively associated with the motor, wherein the motor is responsive to the control device and configured to cause the shaft to move in reciprocating linear motion through the longitudinal bore resulting in the corresponding motion of the decorative object engaged thereto.

5. A system as recited in claim 1, wherein the object is substantially spherical.

6. A system as recited in claim 1, wherein the object includes a hollowed out portion for mounting a light therein.

7. A system as recited in claim 1, wherein the cable tensioning devices comprise a support structure, a drum mounted for rotational motion on the support structure, and a motor for driving the rotational motion of the drum.

8. A system as recited in claim 1, wherein the control device further comprises at least one transmitter positioned adjacent the presentation zone and a control program for operating the synchronized ornamental display by transmitting signals to the cable tensioning devices and light to direct operation thereof.

9. A system as recited in claim 1, wherein the cable tensioning devices are configured to change the amount of tension applied to one or more of the plurality of cables by holding, pulling and releasing portions of cable.

10. A system for providing a synchronized ornamental display in a presentation zone at least partially containing a fluid, comprising: a) a plurality of movable bodies wherein each movable body comprises: i) a support structure, wherein the support structure is at least partially submerged in the fluid during operation of the ornamental display; ii) a decorative object supported by the support structure, wherein the decorative object is substantially viewable during operation of the ornamental display; iii) a light disposed on the object, wherein the light is capable of being illuminated by a remote signal; iv) a plurality of cables coupled to the support structure at their respective first ends; b) a plurality of sets of cable tensioning devices, each set of cable tensioning devices including a plurality of cable tensioning devices being operatively associated with one of the plurality of movable bodies, each cable tensioning device of the plurality of cable tensioning devices in each set being engaged with a respective second end of one cable of the plurality of cables coupled to the support structure of one movable body, wherein the cable tensioning devices of each set are positioned spatially about the periphery of the presentation zone and the spatial arrangement defines a range of desired movement for the operatively associated movable body, and wherein the plurality of cables associated with each movable object are positioned within the fluid to avoid contact with one another; and a control device operatively associated with the tensioning devices and one or more lights, wherein the control device is configured to control movement of the one or more movable bodies by changing the amount of tension applied to one or more of the plurality of cables engaged by the respective sets of cable tensioning devices.

11. A system as recited in claim 10, wherein the support structure comprises a cylindrical member and an elongated member, the elongated member extending substantially perpendicular with respect to one of the parallel planes of the cylindrical member and having a first end connected thereto and a second end associated with the object.

12. A system as recited in claim 11, wherein the first end of each cable of the plurality of cables is connected to the cylindrical member.

13. A system as recited in claim 10, wherein the decorative object associated with at least one movable body is substantially spherical.

14. A system as recited in claim 10, wherein the decorative object includes a hollowed out portion for mounting a light therein.

15. A system as recited in claim 10, further comprising one or more lights positioned within the presentation zone, the lights being controlled by the control device.

16. A system as recited in claim 10, wherein the cable tensioning devices comprise a support structure, a drum mounted for rotational motion on the support structure, and a motor for driving the rotational motion of the drum.

17. A system as recited in claim 10, wherein the control device further comprises at least one transmitter positioned adjacent the presentation zone and a control program for operating the synchronized ornamental display by transmitting signals to the cable tensioning devices and light to direct operation thereof.

18. A system as recited in claim 10, wherein the cable tensioning devices are configured to change the amount of tension applied to one or more of the plurality of cables by holding, pulling and releasing portions of cable.

19. A method for providing a synchronized ornamental display in a presentation zone at least partially containing a fluid, comprising the steps of: actuating a light disposed on a movable body, the movable body comprising a decorative object supported by a support structure wherein the support structure is at least partially submerged in the fluid during operation of the ornamental display; and causing movement of the movable body through the fluid by changing the balance of tension in a plurality of cables relative to one another, each cable of the plurality of cables being coupled at one respective end with the support structure and engaged at a second respective end with a cable tensioning device, wherein the movement of the movable body and actuation of the light are controlled by a remote control device.

20. A method according to claim 19, wherein the step of causing movement of the movable body through the fluid by changing the balance of tension in a plurality of cables further includes holding, pulling and releasing portions of the cables.

* * * * *